US008742673B2

(12) United States Patent
Campbell

(10) Patent No.: US 8,742,673 B2
(45) Date of Patent: Jun. 3, 2014

(54) USAGE TIME CORRECTING ENGINE

(75) Inventor: Gregory Campbell, Walpole, MA (US)

(73) Assignee: Lumenpulse Lighting, Inc. (CA)

( * ) Notice: Subject to any disclaimer, the term of this patent is extended or adjusted under 35 U.S.C. 154(b) by 0 days.

(21) Appl. No.: 13/480,557

(22) Filed: May 25, 2012

(65) Prior Publication Data

US 2013/0293111 A1 Nov. 7, 2013

Related U.S. Application Data

(63) Continuation of application No. 13/464,302, filed on May 4, 2012, now abandoned.

(51) Int. Cl.
*H05B 37/02* (2006.01)

(52) U.S. Cl.
USPC ..... 315/129; 315/149; 315/150; 315/152; 315/291; 315/297; 315/130

(58) Field of Classification Search
USPC ..... 315/291, 297, 152, 209 R, 209, 307, 120
See application file for complete search history.

(56) References Cited

U.S. PATENT DOCUMENTS 7,138,970 B2 11/2006 Krohn
2010/0171429 A1* 7/2010 Garcia et al. ..... 315/149
2011/0115383 A1* 5/2011 Tyson et al. ..... 315/120
2011/0121760 A1 5/2011 Harrison et al.
2011/0254554 A1* 10/2011 Harbers ..... 324/414
2012/0086361 A1* 4/2012 Darshan ..... 315/307

* cited by examiner

*Primary Examiner* — Douglas W Owens
*Assistant Examiner* — Jonathan Cooper
(74) *Attorney, Agent, or Firm* — Burns & Levinson LLP; Joseph M. Maraia

(57) ABSTRACT

A usage time correcting engine, and corresponding method, system, apparatus, and computer product are provided. Over a period of time that an LED lighting fixture is being used to provide light, a usage time correcting engine indirectly measures an internal temperature of a component of the fixture. The indirect measurement is based on a measured external temperature of the component and power output supplied to or provided by the component. The usage time correcting engine determines a multiplier as a function of the indirectly measured internal temperature. The usage time correcting engine multiplies the period of time by the multiplier to provide a corrected measurement of usage of the component. In some examples, the usage time correcting engine determines a remaining lifetime of the LED lighting fixture from the corrected measurement and then reports the remaining lifetime to a user by way of a log, flashing light or other notification/indication.

21 Claims, 5 Drawing Sheets

USAGE TIME CORRECTING ENGINE

RELATED APPLICATIONS

This application is a continuation of U.S. patent application Ser. No. 13/464,302 filed May 4, 2012, now abandoned the entire content of which is incorporated herein by reference.

BACKGROUND

The lifetime of an LED fixture is one of the huge selling points over traditional fixtures like incandescent and fluorescent. An LED lamp or, more familiarly, LED "light bulb" or simply "LED" can last a long time (on the order of tens of thousands of hours) when designed in the correct environment. The lifetime of an LED (and power supply driving the LED for that matter) is based primary on an average temperature of the semiconductor in the LED or "junction temperature" when the LED is emitting light. For example, when the junction temperature is 85° C., LED life is 100,000. That lifetime is halved when junction temperature is increased to 105° C. and doubled when junction temperature is decreased to 55° C. The small size of the LED and its surrounding optics, however, makes measuring the diode junction temperature difficult, costly, and/or impractical to perform with direct methods, such as thermocouples and infrared cameras.

More commonplace, a simple temperature sensor, such as a thermistor, temperature monitoring IC, and thermocouple, is used to read a temperature outside of an LED, like the temperature of a printed circuit board (PCB) on to which the LED is fixed (i.e., the "LED board temperature"). A typical temperature sensor application includes monitoring an LED fixture for an over-temperature situation. For example, a fixture is located outside of a building in Las Vegas and is exposed to a high ambient (external) temperature. In this example application, the temperature sensor is used to trigger some predefined over-temperature condition and shuts the fixture off until some normal operating temperature is retained. In some cases, the temperature sensor may throttle back or decrease light output by the fixture.

In another example application, an LED fixture uses the external temperature as a light output barometer. Meaning, the LED fixture varies the current through an LED in order to try to maintain a certain temperature. The barometer approach attempts to take ambient (external) temperature out of the mix as a variable. For example, the fixture tries to maintain an 85° C. junction temperature maximum. When the ambient (external) temperature is 25° C., the 85° C. junction temperature correlates to the fixture operating at full (100%) output. When the fixture is operating at a higher ambient (external) temperature of 50° C., the fixture may regulate light output (and power) from 100% to 70% in order to maintain the 85° C. junction temperature.

Many LED manufacturers list an estimated LED lifetime on their specification sheets as the amount of time their fixture can run at full (100%) output before an LED lamp inside the fixture is reduced to 70% of the rated light output. These estimations are extremely conservative. Most LED fixtures are routinely controlled and dimmed in some manner (sometimes permanently or long periods of times), and run at less than full (i.e., >100%) output. When an LED fixture is dimmed, its power supply outputs less current to the LED lamp and the lamp appear less bright. Driving the LED with less current lowers the junction temperature experienced by the LED and thus, extends the life of the LED. Simply put, a LED fixture that is dimmed on a regular basis has a far greater lifetime then an LED fixture that is always at full (100%) output.

Simply timing how long time an LED fixture is in use with a timer assumes that an LED is operating at 100% output. In actual use, however, at any given moment, the LED may be outputting less than or more than 100%. In some cases, when the timer reaches the estimated LED lifetime, there is still usable life left in the LED. This may result in waste because it is common to replace the LED when the estimated LED lifetime is reached (e.g. as a part of maintenance schedule or routine). In other cases, the LED is outputting a less-than-acceptable level of light before the timer reaches the estimated LED lifetime. This may result in some LED applications, such as imaging, to perform sub-optimally, or worse, not at all.

In still other cases, the foregoing problems are exacerbated by certain LED fixture designs in which the timer is part of a microprocessor. Even if the fixture is set to "off," so as long as the microprocessor is running, the microprocessor/timer combination is still clocks lifetime. This works in the "negative" direction because the fixture may be "on" and the microprocessor running for the almost 24 hours, but the fixture may be emitting light for only 8-10 hours of that day.

Clearly, in some cases, simply measuring usage time (e.g., using a timer or timer in a microprocessor) leads to unpredictable results that make commissioning, maintaining, and/or sustaining LED fixtures, in particular, LED lamps, difficult and expensive. Therefore, there is a need for technique for determining and, in some cases, reporting the lifetime of components of an LED lighting fixture that accurately reflects actual use of the components.

SUMMARY

Described herein are techniques and devices for determining usage time of components of an LED lighting fixture. In particular, a corrected usage time, which accurately reflects actual use of the components, is provided by correcting a measured usage time for temperature. In some aspects, this disclosure provides a process including, over a period of time that the LED lighting fixture is being used to provide light, indirectly measuring an internal temperature of a component of the LED lighting fixture based on a measured external temperature of the component and power output supplied to or provided by the component. The process includes determining a multiplier as a function of the indirectly measured internal temperature. The process includes multiplying the period of time by the multiplier to provide a corrected measurement of usage of the component.

In some aspects, this disclosure provides an apparatus including one or more modules configured to perform the operations of, over a period of time that the LED lighting fixture is being used to provide light, indirectly measure an internal temperature of the component of the LED lighting fixture based on the measured external temperature of the component and power output supplied to or provided by the component. The one or more modules are also configured to perform the operations of determine a multiplier as a function of the indirectly measured internal temperature.

The one or more modules are also configured to perform the operations of, multiply the period of time by the multiplier to provide a corrected measurement of usage of the component.

In some aspects, this disclosure provides a system including a temperature monitoring module configured to measure external temperature of a component and a power output monitoring module configured to measure power output supplied to or provided by the component. The system also including a microprocessor communicatively coupled to the temperature and power output monitoring modules. The microprocessor configured to, over a period of time that the LED lighting fixture is being used to provide light, indirectly measure an internal temperature of the component of the LED lighting fixture based on the measured external temperature of the component and power output supplied to or provided by the component. The microprocessor also configured to determine a multiplier as a function of the indirectly measured internal temperature and multiply the period of time by the multiplier to provide a corrected measurement of usage of the component. The system also including a communication interface communicatively coupled to the microprocessor. The communication interface configured to report the corrected measurement.

In some aspects, this disclosure provides a computer-readable storage medium encoded with instructions that when executed by a data processing apparatus, cause the data processing apparatus to, over a period of time that the LED lighting fixture is being used to provide light, indirectly measure an internal temperature of a component of the LED lighting fixture based on a measured external temperature of the component and power output supplied to or provided by the component. The data processing apparatus is also caused to determine a multiplier as a function of the indirectly measured internal temperature and to multiply the period of time by the multiplier to provide a corrected measurement of usage of the component.

In other examples, any of the aspects above can include one or more of the following features.

In some examples, the component of the LED lighting fixture is selected from a group consisting of an LED and power supply.

In other examples, the measuring step includes averaging a plurality of indirectly measured internal temperatures over time.

In some examples, the measuring step includes determining a change in temperature due to the power output and summing the measured external temperature and the change in temperature to provide the indirectly measured internal temperature.

In other examples, the measuring step includes reading a dimmer value specifying the power output supplied to or provided by the component.

In some examples, the determining step includes looking up a corresponding multiplier associated with the indirectly measured internal temperature In other examples, the method further includes measuring the external temperature.

In some examples, the method further includes measuring the power output supplied to or provided by the component.

In other examples, the method further includes storing the corrected measurement together with other corrected measurements.

In some examples, the method further includes reporting the corrected measurement to a user.

In other examples, the method further includes determining a remaining lifetime of the LED lighting fixture from the corrected measurement, and then performing any one of: reporting the determined remaining lifetime to a user, reducing an amount of power output supplied to or provided by the component based on the determined remaining lifetime of the LED lighting fixture, and combination thereof.

In some examples, the method further includes performing any one of: reporting the determined remaining lifetime to the user, reducing the amount of power output supplied to or provided by the component, and combination thereof when the determined remaining lifetime exceeds a threshold value.

In other examples, the method further includes reporting the determined remaining lifetime to the user by way of a notification selected from a group consisting of a log, flashing light, visual light communication, wireless local area network (WLAN) communication, signee communication, power line communication, digital multiplex with 512 pieces of information (DMX215) communication, and remote device management (RDM) communication.

In other examples, the microprocessor is further configured to indirectly measure the internal temperature by averaging a plurality of indirectly measured internal temperatures over time.

In some examples, the microprocessor is further configured to indirectly measure the internal temperature by determining a change in temperature due to the power output and summing the measured external temperature and the change in temperature to provide the indirectly measured internal temperature.

In other examples, the microprocessor is further configured to indirectly measure the internal temperature by reading a dimmer value specifying the power output supplied to or provided by the component.

In some examples, the microprocessor is further configured to determine the multiplier by looking up a corresponding multiplier associated with the indirectly measured internal temperature.

In other examples, the temperature monitoring module is any one of thermistor, temperature monitoring integrated circuit, and thermocouple.

In some examples, the power output monitoring module is any one of current measuring series resistor, voltage measuring device, and combination thereof.

In other examples, the communication interface provides the corrected measurement using any one of the following protocols: Remote Device Management (RDM), power line communication (PLC), wireless local area network (WLAN), Digital Addressable Lighting Interface (DALI), ZigBee, and visual light communication.

In some examples, the system further includes a determination module configured to determine a remaining lifetime of the LED lighting fixture from the corrected measurement and to report the determined remaining lifetime to a user by way of a notification selected from a group consisting of a log, flashing light, visual light communication, wireless local area network (WLAN) communication, signee communication, power line communication, digital multiplex with 512 pieces of information (DMX215) communication, and remote device management (RDM) communication.

In other examples, the determination module is configured to perform any one of: report the determined remaining lifetime to the user, reduce the amount of power output supplied to or provided by the component, and combination thereof when the determined remaining lifetime exceeds a threshold value.

In other examples, the determination module is configured to perform any one of: report the determined remaining lifetime to the user, reduce the amount of power output supplied to or provided by the component, and combination thereof when the determined remaining lifetime exceeds a threshold value.

The techniques and devices described herein can provide one or more the following advantages. An advantage of the technology is that it identifies a time to replace a dimmed fixture (or LED therein) that is later than a time to replace a non-dimmed (or less dimmed) fixture (or LED therein). Another advantage of the technology is keeping an LED fixture (or LED therein), which has reached its estimated lifetime, in service until all or some portion of its remaining life is used. Yet another advantage of the technology is that it identifies a time to replace a fixture (or LED therein) with a degraded light output that occurs before its estimated lifetime is reached.

DETAILED DESCRIPTION

As an overview of the processes and apparatuses (hereinafter the "technology") for determining the usage of an LED fixture component, the technology includes a usage time correcting engine. The usage time correcting engine adjusts a measurement of an amount of time the component is in use or "measured usage time" based on the temperature of the component. In operation, the usage time correcting engine "increases" the measured usage time of the component (i.e., corrected usage time>measured usage time) when the component is hotter than a predefined temperature corresponding to the component running at full (100%) output. The usage time correcting engine "decreases" the measured usage time of the component (i.e., corrected usage time<measured usage time) when the component is cooler than the predefined temperature. The lifetime of a component is dependent, largely, on the temperature of the component in use. By correcting a measured usage time based on temperature, the usage time correcting engine provides a measurement of how long the component is in use more accurate than a time measurement taken using a timer, for example.

The usage time correcting engine measures the internal temperature of the component, indirectly, using an external temperature of the component (or its surroundings) and power being supplied to the component or being supplied by the component. In this regard, the usage time correcting engine can be used, advantageously, in applications in which it is impossible or difficult to measure the internal temperature of the component, directly, because of the small size of the component, for example.

The usage time correcting engine determines a time correction or adjustment that is based on the internal temperature of the component. The lifetime of a component depends, largely, on the internal temperature of the component when the component is operating. For example, when the internal temperature of the component is 85° C., then the lifetime of the component is 100,000 hours. That lifetime is reduced by half when the internal temperature is increased from 85° C. to 105° C. Conversely, reducing the internal temperature of the component from 85° C. to 55° C. doubles the lifetime of the component. The internal temperature at the component, in turn, is affected by the thermal design of the LED fixture (e.g., the use of heat sinks), the amount of current driving the LED (e.g., being dimmed), and the ambient or external temperature of the environment in which the LED fixture operates. In this regard, the usage time correcting engine advantageously provides a measure of use that accurately reflects actual usage time and how the component is used.

Figure 1:
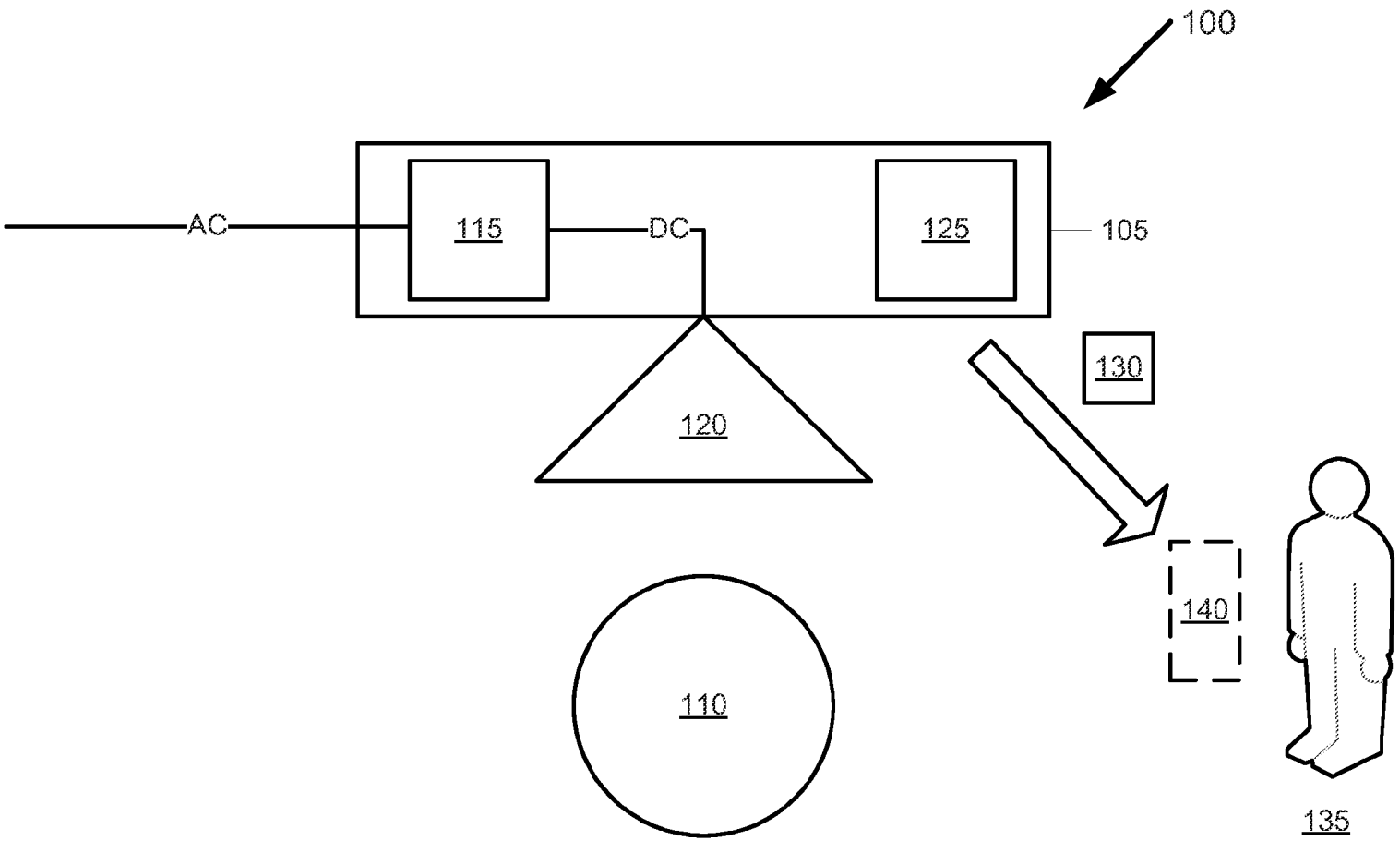
FIG. 1 is a diagram of an example lighting environment in which examples of a usage time correcting engine may be used.

FIG. 1 shows an example lighting environment 100 including a LED fixture 105 lighting up an object 110. The LED fixture 105 includes a power supply 115 and LED lamp 120. Line voltage (e.g., 110 volts or 220 volts alternating current or "AC") is supplied to the LED fixture 105. The power supply 115 converts the AC line voltage being supplied into direct current or "DC" (e.g., 5 volts). The power supply then provides the direct current to the LED lamp 120. The LED lamp 120 in turn emits light to illuminate the object 110 and, in the process, generates heat.

The LED fixture 105 further includes a usage time correcting engine 125 that provides a measurement of LED lamp usage that is corrected for the temperature of LED lamp 120. In some examples, the usage time correcting engine 125 measures the heat generated by the LED lamp 120 over a period of time (e.g., 55° C. over 15 minutes). The usage time correcting engine 125 then adjusts the period of time the LED lamp is in use (15 minutes) based on the temperature of the LED lamp (55° C.) to produce a corrected measurement of LED lamp usage 130 (e.g., 10 minutes).

In some examples, the usage time correcting engine 125 provides the corrected measurement of LED lamp usage 130 as an audio and/or visual representation of the measurement to an operator 135 (e.g., flashing LED lamp). In other examples, usage time correcting engine 125 provides the measurement 130 to a device 140 (shown as a phantom connection) used by the operator. In yet other examples, the corrected measurement 130 may be communicated to the users 135 and/or device 140 using one or more communications (or messages) provided (encoded) in accordance with Remote Device Management (RDM), digital multiplex with 512 pieces of information (DMX215), power line communication (PLC), wireless local area network (WLAN), Digital Addressable Lighting Interface (DALI), ZigBee, or visual light communication.

In other examples, usage time correcting engine 125 stores the measurement 130 in a storage device communicatively coupled to the usage time correcting engine 125 so that the measurement and other stored measurements can be retrieved at a later time by, for example, the operator 135 or an application (such as one running on the device 140).

In yet other examples, the usage time correction engine 125 is connected to a server along with other usage time correction engines. Each engine of the collection in providing a respective corrected measurement associated with a corresponding LED fixture. In this "network" approach, the server acts like a collection point for receiving corrected measurements, which may include further processing of the measurements.

Figure 2:
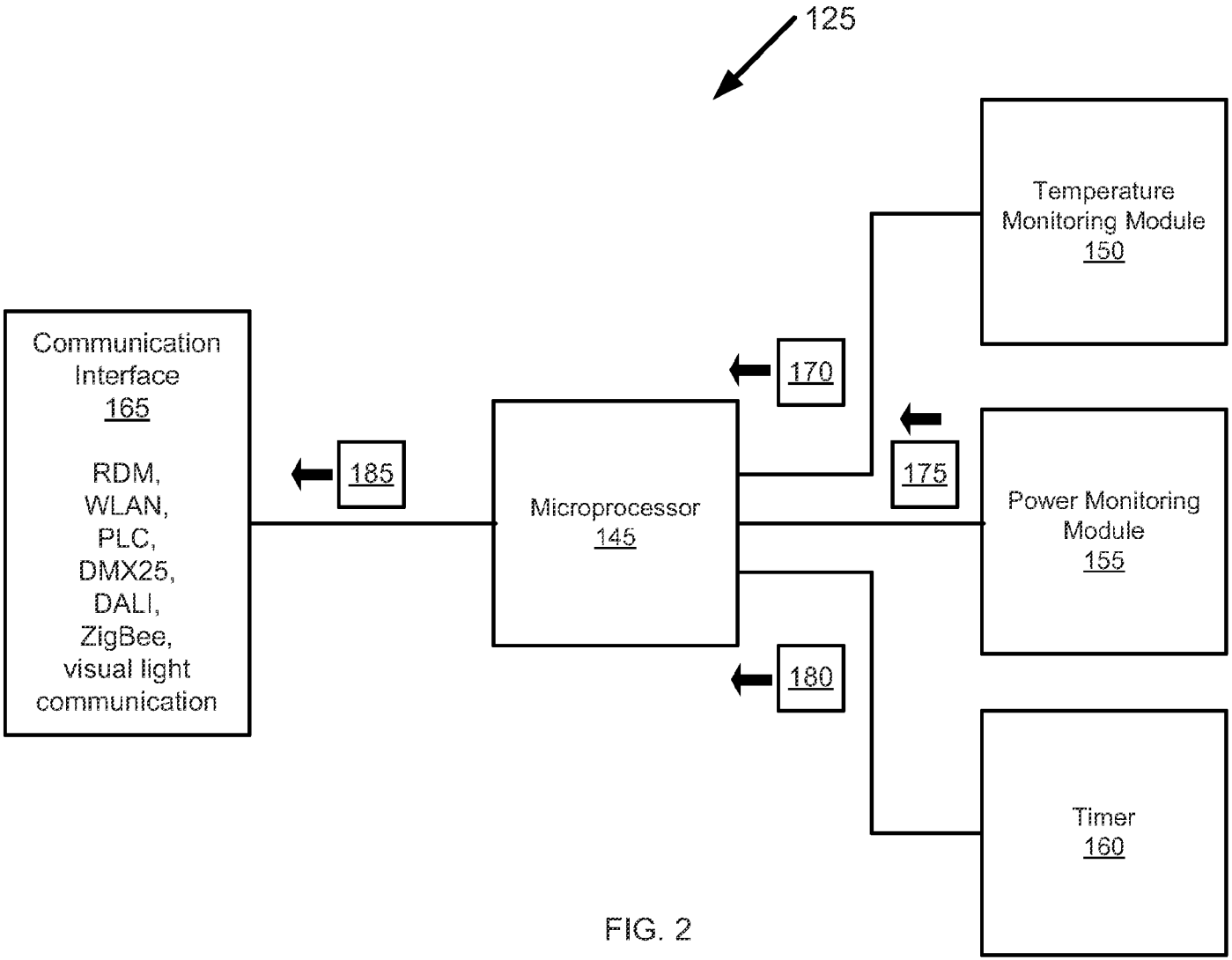
FIG. 2 is a diagram of an example usage time correcting engine.

FIG. 2 shows some implementations of the usage time correcting engine 125 in greater detail. The usage time correcting engine 125 includes a microprocessor 145, temperature monitoring module 150, power monitoring module 155, timer 160, and communication interface 165. In a convenient example, the timer 160 is incorporated with the microprocessor 145. In operation, the temperature monitoring module 150 measures the external temperature of a component, such as the power supply 115 and/or LED lamp 120 of FIG. 1. In a convenient example, the temperature monitoring module 150 measures the temperature of an environment external to the component, such as a printed circuit board (PCB) on to which the component is attached. The temperature monitoring module 150 provides the measured external temperature 170 to a microprocessor 145 as one of the inputs. In some examples, the temperature monitoring module 150 is a thermistor, temperature monitoring integrated circuit or thermocouple.

Continuing with the operation of the usage time correcting engine 125, the power supply monitoring module 155 measures power being outputted by the component. The power supply monitoring module 155 provides a power measurement 175 to the microprocessor 145 as another input. In some examples, the power supply monitoring module 155 is current measuring series resistor, voltage measuring device, or a combination of the two.

In some examples, the microprocessor 145 is programmed to read the measured external temperature 170 from the temperature monitoring module 150 and power measurement 175 from the power supply monitoring module 155, every 15 minutes (or other increment of time) clocked by the timer 160. In FIG. 2, the "clock" is referenced as 180.

In this "bucket approach," the microprocessor 145 then uses the measured external temperature 170 and power measurement 175, which are read every 15 minutes (or other increment of time) to indirectly measure an internal temperature of the component. In a convenient example, the microprocessor 145 computes the internal temperature ($T_J$) according to the equation: $T_J=T_A+(R_{\theta JA}\times P_D)$, in which $T_A$ is the measured external temperature of the component (ambient temperature for a package), $R_{\theta JA}$ is the junction to ambient thermal resistance, and $P_D$ is the power output supplied to or provided by the component (power dissipation in the package). For example, given an external measured temperature of 75° C., an LED driven at 1 W, and a thermal resistance of 8° C./W, the internal junction temp is 83° C. The microprocessor 145 then determines a multiplier (or correction factor) as a function of the indirectly measured internal temperature to provide a corrected measurement 185 of usage of the component, as described in greater detail immediately below.

Figure 3:
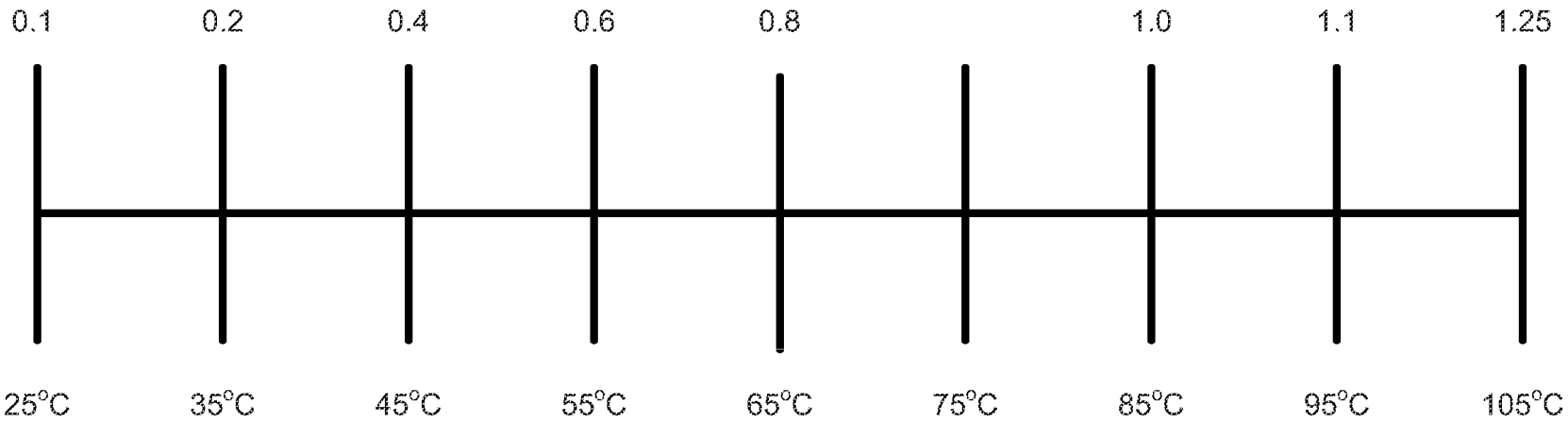

FIG. 3 shows, as an example, internal component temperatures (lower numbers) associated with correction factors or multipliers (upper numbers). In a convenient example, the associations of FIG. 3 are extrapolated from known values, such as the ones provided in the table below.

| Junction temperature | Output |
|---|---|
| 55° C. | 60% |
| 85° C. | 100% |
| 100° C. | 125% |

At a given internal component temperature, there is a corresponding correction factor or multiplier. The usage time correcting engine 125 uses the correction factor or multiplier to adjust a period of time over which the given temperature is measured. For example, the internal temperature of a component measures 55° C. over a period of one minute, which for ease of reference is called the "measured usage time." The correction factor of 0.6 corresponds to the internal component temperature of 55° C. The usage time correcting engine 125 adjusts the measured usage time by multiplying the measured usage time of one minute by the correction factor of 0.6. The result is a "corrected usage time" of 0.6 minutes or 36 seconds. In other words, because the LED ran at 60% output, effectively only 36 seconds of the life of the LED was used up and not one minute.

As another example, the internal temperature of a component measures 105° C. over one minute. The correction factor of 1.25 corresponds to the internal component temperature of 105° C. The usage time correcting engine 125 adjusts the measured usage time by multiplying the measured usage time of one minute by the correction factor of 1.25. The result is a "corrected usage time" of 1.25 minutes or 1 minute and 15 seconds. In other words, because the LED ran at 125% output, effectively 1 minute and 15 seconds of the life of the LED was used up and not one minute.

In other examples, the usage time correcting engine 125 looks up in a table a corresponding multiplier associated with the indirectly measured internal temperature. The table may be stored in a data store, which is accessible to the usage time correcting engine 125, as a data structure, such as an array. In some examples, the table may be downloaded into the data store.

Returning to FIG. 2, the microprocessor provides the corrected measurement 185 to the communication interface 165. In a convenient example, the communication interface 165 communicates the corrected measurement using any one of the following communication protocols: Remote Device Management (RDM), digital multiplex with 512 pieces of information (DMX215), power line communication (PLC), and wireless local area network (WLAN), Digital Addressable Lighting Interface (DALI), ZigBee, and visual light communication. In some examples, such corrected measurement communications is a byte of data (encoding 0-255 possible values) or 2 bytes of data (encoding 0-65535 possible values).

Figure 4:
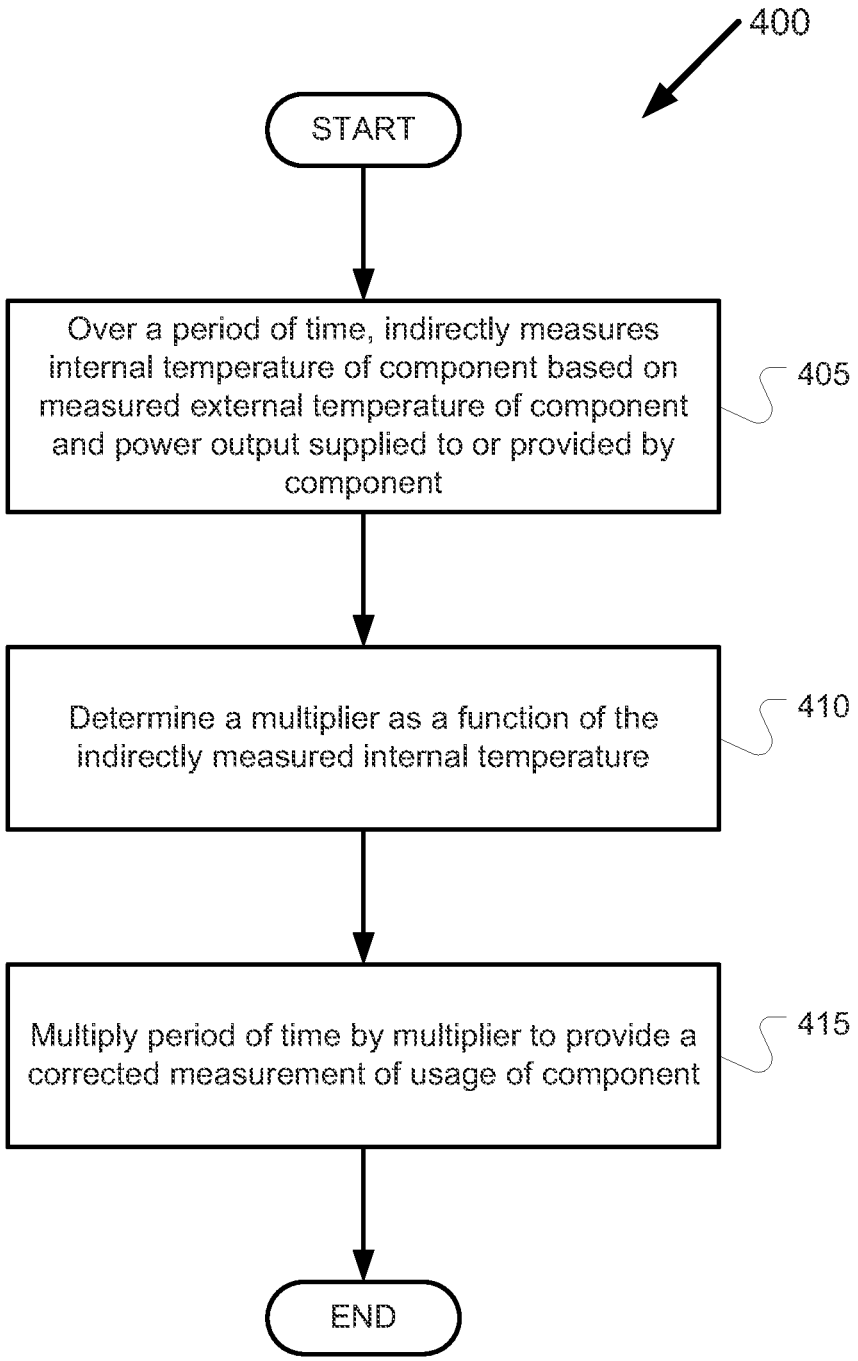
FIG. 4 is a flowchart of an example usage time correcting procedure.

FIG. 4 shows an example procedure 400 for correcting a measurement of usage of a LED lighting fixture component using, for example, the usage time correcting engine 125 of FIG. 2. Over a period of time that the LED lighting fixture is being used to provide light, the usage time correcting engine 125 indirectly measures (405) an internal temperature of a component of the LED lighting fixture based on a measured external temperature of the component and power output supplied to or provided by the component. The usage time correcting engine 125 then determines (410) a multiplier (or correction factor) as a function of the indirectly measured internal temperature. The usage time correcting engine 125 then multiplies (415) the period of time by the multiplier to provide a corrected measurement of usage of the component.

Figure 5:
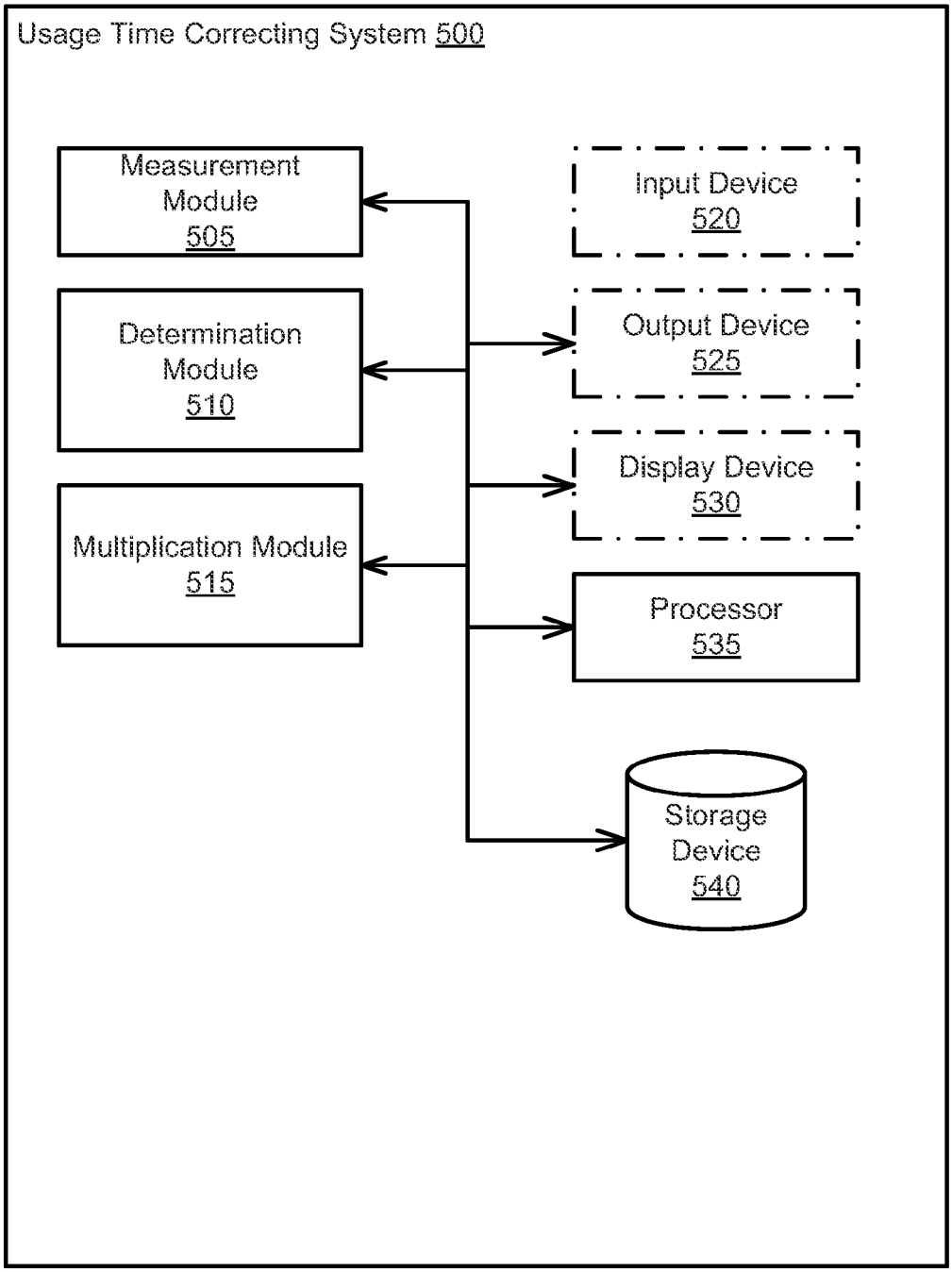
FIG. 5 is a block diagram of an example usage time correcting system.

FIG. 5 shows an example system 500 for implementing a usage time correcting procedure, such as the one shown in reference to FIG. 4. The system 500 includes a measurement module 505, determination module 510, multiplication module 515, input device 520, output device 525, display device 530, processor 535, and storage device 540, communicatively coupled to each other as shown in FIG. 5.

The modules and devices described herein can, for example, utilize the processor 535 to execute computer executable instructions and/or include a processor to execute computer executable instructions (e.g., an encryption processing unit, a field programmable gate array processing unit, etc.). It should be understood that the system 500 can include, for example, other modules, devices, and/or processors known in the art and/or varieties of the illustrated modules, devices, and/or processors. The input device 520, output device 525, and/or display device 530 are optional components of the system 500. Although FIG. 5 shows the system 500 as including the separate modules described herein, the modules can be embedded within other modules.

The measurement module 505, over a period of time that an LED lighting fixture is being used to provide light, indirectly measures an internal temperature of the component of the LED lighting fixture based on the measured external temperature of the component and power output supplied to or provided by the component. In some examples, the input device(s) 520, such as the temperature monitoring module 150 and power monitoring module 155 of FIG. 2, measure the external temperature of the component and the power output supplied to or provided by the component, and then provide the measurements to the measurement module 505. In other examples, the storage device 540 provides a stored external temperature measurement and stored power output measurement to the measurement module 505. The storage device 540, such as a hard drive, stores the external temperature and power output measurements, which are provided to the measurement module 505, along with other stored measurements.

The determination module 510 determines a multiplier as a function of the indirectly measured internal temperature. The multiplication module 515 then multiples the period of time by the multiplier to provide a corrected measurement of usage of the component. In some examples, the multiplication module 515 provides the corrected measurement or result to the output device 525, which in turn provides the results to a user, for example, as a printout. In other examples, the multiplication module 515 provides the results to the display device 530 and the results are displayed to the user.

The above-described examples of the usage time correcting engine and corresponding systems and methods can be implemented in digital electronic circuitry, in computer hardware, firmware, and/or software. The implementation can be as a computer program product. The implementation can, for example, be in a machine-readable storage device, for execution by, or to control the operation of, data processing apparatus. The implementation can, for example, be a programmable processor, a computer, and/or multiple computers.

A computer program can be written in any form of programming language, including compiled and/or interpreted languages, and the computer program can be deployed in any form, including as a stand-alone program or as a subroutine, element, and/or other unit suitable for use in a computing environment. A computer program can be deployed to be executed on one computer or on multiple computers at one site.

Method steps can be performed by one or more programmable processors executing a computer program to perform functions of the invention by operating on input data and generating output. Method steps can also be performed by and an apparatus can be implemented as special purpose logic circuitry. The circuitry can, for example, be a FPGA (field programmable gate array) and/or an ASIC (application specific integrated circuit). Subroutines and software agents can refer to portions of the computer program, the processor, the special circuitry, software, and/or hardware that implement that functionality.

Processors suitable for the execution of a computer program include, by way of example, both general and special purpose microprocessors, and any one or more processors of any kind of digital computer. Generally, a processor receives instructions and data from a read-only memory or a random access memory or both. The essential elements of a computer are a processor for executing instructions and one or more memory devices for storing instructions and data. Generally, a computer can be operatively coupled to receive data from and/or transfer data to one or more mass storage devices for storing data (e.g., magnetic, magneto-optical disks, or optical disks).

Data transmission and instructions can also occur over a communications network. Computer program products suitable for embodying computer program instructions and data include all forms of non-volatile memory, including by way of example semiconductor memory devices. The computer program products can, for example, be EPROM, EEPROM, flash memory devices, magnetic disks, internal hard disks, removable disks, magneto-optical disks, CD-ROM, and/or DVD-ROM disks. The processor and the memory can be supplemented by, and/or incorporated in special purpose logic circuitry.

To provide for interaction with a user, the above described techniques can be implemented on a computer having a display device. The display device can, for example, be a cathode ray tube (CRT) and/or a liquid crystal display (LCD) monitor. The interaction with a user can, for example, be a display of information to the user and a keyboard and a pointing device (e.g., a mouse or a trackball) by which the user can provide input to the computer (e.g., interact with a user interface element). Other kinds of devices can be used to provide for interaction with a user. Other devices can, for example, be feedback provided to the user in any form of sensory feedback (e.g., visual feedback, auditory feedback, or tactile feedback). Input from the user can, for example, be received in any form, including acoustic, speech, and/or tactile input.

The above described techniques can be implemented in a distributed computing system that includes a back-end component. The back-end component can, for example, be a data server, a middleware component, and/or an application server. The above described techniques can be implemented in a distributing computing system that includes a front-end component. The front-end component can, for example, be a client computer having a graphical user interface, a Web browser through which a user can interact with an example implementation, and/or other graphical user interfaces for a transmitting device. The components of the system can be interconnected by any form or medium of digital data communication (e.g., a communication network). Examples of communication networks include a local area network (LAN), a wide area network (WAN), the Internet, wired networks, and/or wireless networks.

The system can include clients and servers. A client and a server are generally remote from each other and typically interact through a communication network. The relationship of client and server arises by virtue of computer programs running on the respective computers and having a client-server relationship to each other.

Packet-based networks can include, for example, the Internet, a carrier internet protocol (IP) network (e.g., local area network (LAN), wide area network (WAN), campus area network (CAN), metropolitan area network (MAN), home area network (HAN)), a private IP network, an IP private branch exchange (IPBX), a wireless network (e.g., radio access network (RAN), 802.11 network, 802.16 network, general packet radio service (GPRS) network, HiperLAN), and/or other packet-based networks. Circuit-based networks can include, for example, the public switched telephone network (PSTN), a private branch exchange (PBX), a wireless network (e.g., RAN, bluetooth, code-division multiple access (CDMA) network, time division multiple access (TDMA) network, global system for mobile communications (GSM) network), and/or other circuit-based networks.

The transmitting device can include, for example, a computer, a computer with a browser device, a telephone, an IP phone, a mobile device (e.g., cellular phone, personal digital assistant (PDA) device, laptop computer, electronic mail device), and/or other communication devices. The browser device includes, for example, a computer (e.g., desktop computer, laptop computer) with a world wide web browser (e.g., Microsoft® Internet Explorer® available from Microsoft Corporation, Mozilla® Firefox available from Mozilla Corporation). The mobile computing device includes, for example, a Blackberry®.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing examples are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

The invention claimed is:

1. A method for correcting a measurement of usage of a light emitting diode (LED) lighting fixture component for determining the life expectancy of the LED, each LED having a junction to ambient thermal resistance ($R_{\theta jA}$ in ° C./W), the method comprising:

in a microprocessor of a LED lighting fixture, over a period of time that the LED lighting fixture is being used to provide light;

measuring, in the LED lighting fixture, a temperature ($T_A$ in ° C.) external to the component;

measuring a power output ($P_D$ in W) supplied to or provided by the component;

calculating an internal temperature of the component of the LED lighting fixture ($T_J$ in ° C.) based on the equation: $T_J=T_A+(R_{\theta JA}\times P_D)$;

determining a multiplier as a function of the calculated internal temperature ($T_J$ in ° C.); and multiplying the period of time by the multiplier to provide a corrected measurement of usage of the component.

2. The method of claim 1 wherein the component of the LED lighting fixture is selected from a group consisting of an LED and power supply.

3. The method of claim 1 wherein determining the multiplier includes looking up a corresponding multiplier associated with the calculated internal temperature.

4. The method of claim 1 further comprising measuring the external temperature.

5. The method of claim 1 further comprising storing the corrected measurement together with other corrected measurements.

6. The method of claim 1 further comprising reporting the corrected measurement to a user.

7. The method of claim 1 further comprising determining a remaining lifetime of the LED lighting fixture from the corrected measurement; and performing any one of:

reporting the determined remaining lifetime to a user, reducing an amount of power output supplied to or provided by the component based on the determined remaining lifetime of the LED lighting fixture, and combination thereof.

8. The method of claim 7 wherein reporting includes reporting the determined remaining lifetime to the user by way of a notification selected from a group consisting of a log, flashing light, visual light communication, wireless local area network (WLAN) communication, signee communication, power line communication, digital multiplex with 512 pieces of information (DMX512) communication, and remote device management (RDM) communication.

9. The method of claim 7 wherein performing includes performing any one of:

reporting the determined remaining lifetime to the user, reducing the amount of power output supplied to or provided by the component, and combination thereof when the determined remaining lifetime exceeds a threshold value.

10. A system for correcting a measurement of usage of a light emitting diode (LED) lighting fixture component for determining the life expectancy of the LED, each LED having a junction to ambient thermal resistance ($R_{\theta JA}$ in ° C./W), the system comprising:

a temperature monitoring module configure to measure, in an LED lighting fixture, a temperature ($T_A$ in ° C.) external to the component;

a power output monitoring module configured to measure power output ($P_D$ in W) supplied to or provided by the component;

a microprocessor communicatively coupled to the temperature and power output monitoring modules, the microprocessor configured to:

over a period of time that the LED lighting fixture is being used to provide light:

calculate an internal temperature of the component of the LED lighting fixture ($T_J$ in ° C.) based on the equation: $T_J=T_A+(R_{\theta JA}\times P_D)$;

determine a multiplier as a function of the calculated internal temperature ($T_J$ in ° C.);

multiply the period of time by the multiplier to provide a corrected measurement of usage of the component; and a communication interface communicatively coupled to the microprocessor, communication interface configured to report the corrected measurement.

11. The system of claim 10 wherein the component of the LED lighting fixture is any one of an LED lamp and power supply.

12. The system of claim 10 wherein the microprocessor is configured to determine the multiplier by looking up a corresponding multiplier associated with the calculated internal temperature.

13. The system of claim 10 wherein the temperature monitoring module is any one of thermistor, temperature monitoring integrated circuit, and thermocouple.

14. The system of claim 10 wherein the power output monitoring module is any one of current measuring series resistor, voltage measuring device, and combination thereof.

15. The system of claim 10 further comprising a storage module communicatively coupled to the microprocessor, the storage module configured to store the corrected measurement together with other corrected measurements.

16. The system of claim 10 wherein the communication interface provides the corrected measurement using any one of the following protocols: Remote Device Management (RDM), power line communication (PLC), wireless local area network (WLAN), Digital Addressable Lighting Interface (DALI), ZigBee, and visual light communication.

17. The system of claim 10 further comprising a determination module configured to determine a remaining lifetime of the LED lighting fixture from the corrected measurement; and perform any one of: reporting the determined remaining lifetime to a user, reducing an amount of power output supplied to or provided by the component based on the determined remaining lifetime of the LED lighting fixture, and combination thereof.

18. The system of claim 17 wherein the determination module is further configured to report the determined remaining lifetime to the user by way of a notification selected from a group consisting of a log, flashing light, visual light communication, wireless local area network (WLAN) communication, signee communication, power line communication, digital multiplex with 512 pieces of information (DMX512) communication, and remote device management (RDM) communication.

19. The system of claim 17 wherein the determination module is configured to perform any one of: report the determined remaining lifetime to the user, reduce the amount of power output supplied to or provided by the component, and combination thereof when the determined remaining lifetime exceeds a threshold value.

20. An apparatus for correcting a measurement of usage of a light emitting diode (LED) lighting fixture component for determining the life expectancy of the LED, each LED having a junction to ambient thermal resistance ($R_{\theta JA}$ in ° C./W), the apparatus comprising:

a measurement module configured to, over a period of time that the LED lighting fixture is being used to provide light:

measure, in the LED lighting fixture, a temperature ($T_A$ in ° C.) external to the component;

measure a power output in ($P_D$ in W) supplied to or provided by the component;

calculate an internal temperature of the component of the LED lighting fixture ($T_J$ in ° C.) based on the equation: $T_J=T_A+(R_{\theta JA}\times P_D)$;

a determination module communicatively coupled to the measurement module configured to determine a multiplier as a function of the calculated internal temperature ($T_J$ in ° C.); and a multiplication module communicatively coupled the determination module configured multiply the period of time by the multiplier to provide a corrected measurement of usage of the component.

21. A computer program product, tangibly embodied in a non-transitory information carrier, the computer program product including instructions being operable to cause a data processing apparatus to:

over a period of time that LED lighting fixture is being used to provide light, each LED having a junction to ambient thermal resistance ($R_{\theta JA}$ in ° C./W), measure, in the LED lighting fixture, a temperature $T_A$ in ° C.) external to the component;

measuring a power output ($P_D$ in W) supplied to or provided by the component;

calculating an internal temperature of the component of the LED lighting fixture ($T_J$ in ° C.) based on the equation: $T_J=T_A+(R_{\theta JA}\times P_D)$;

determining a multiplier as a function of the calculated internal temperature ($T_J$ in ° C.); and multiply the period of time by the multiplier to provide a corrected measurement of usage of the component.

* * * * *